United States Patent [19]

Andrascek et al.

[11] Patent Number: 4,481,035

[45] Date of Patent: Nov. 6, 1984

[54] CHEMICAL GILDING BATH

[75] Inventors: Ernst Andrascek; Hans Hadersbeck; Friedhelm Wallenhorst, all of Munich, Fed. Rep. of Germany

[73] Assignee: Siemens Aktiengesellschaft, Berlin & Munich, Fed. Rep. of Germany

[21] Appl. No.: 526,374

[22] Filed: Aug. 25, 1983

[30] Foreign Application Priority Data

Oct. 8, 1982 [DE] Fed. Rep. of Germany ..... 3237394

[51] Int. Cl.[3] ..... C23C 3/02

[52] U.S. Cl. ..... 106/1.23; 427/437; 427/443.1

[58] Field of Search ..... 106/1.23; 428/671, 674; 427/437, 443.1

[56] References Cited

U.S. PATENT DOCUMENTS

| | | | |
|---|---|---|---|
| 3,403,035 | 9/1968 | Schneble et al. | 427/443.1 |
| 3,597,267 | 8/1971 | Mallory et al. | 427/437 |
| 4,337,091 | 6/1982 | El-Shazly et al. | 106/1.23 |
| 4,374,876 | 2/1983 | El-Shazly et al. | 106/1.23 |

OTHER PUBLICATIONS

Okinaka et al., Plating & Surface Finishing, 57, 914, (1970).

Okinaka et al., Plating & Surface Finishing, 58, 1080, (1971).

Feldstein, "Electroless (Autocatalytic) Plating" Metal Finishing Guidebook and Directory, 1981 issue, pp. 504, 506, 508, 510, 512.

*Primary Examiner*—Veronica P. Hoke

*Attorney, Agent, or Firm*—Hill, Van Santen, Steadman & Simpson

[57] ABSTRACT

A chemical gilding bath is formulated on the basis of an alkaline, aqueous solution of an alkali gold cyanide complex and has a reducing agent and a stabilizing agent therein. The reducing agent is an organic compound containing at least one enol group within the molecular structure thereof, such as ascorbic acid or salts thereof. The pH value of the bath is adjusted by a buffer solution so as to range between about 7.5 to 12 and preferably is about 8.

8 Claims, No Drawings

CHEMICAL GILDING BATH

BACKGROUND OF THE INVENTION

1. Field of the Invention

The invention relates to chemical gilding baths for electrodless gilding or coating of metals and somewhat more particularly to a chemical gilding bath formulation having a water-soluble alkali gold cyanide complex therein which functions in the alkaline pH range, along with a reducing agent and a stabilizing agent.

2. Prior Art

So-called contact or, respectively, exchange gilding baths are known which do not function galvanically upon passage of a direct electrical current but, rather, are considered as being chemical gilding baths. In these type of contact or exchange gilding baths, the corresponding electrical charges are generated by catalytic oxidation. Such baths, however, exhibit a rather serious disadvantage because the gold deposition occurs in a non-uniform manner. As a result thereof, it frequently ensues that individual punctiform surfaces are either not gilded at all or blemishes of a different type occur on such surfaces, such as, for example, scars, so that the gold plating or gilding is considered defective. Similarly, the appearance of dark discolorations on surface areas being gilded is considered defective.

SUMMARY OF THE INVENTION

The invention provides a gilding bath formulation which provides a substantially uniform deposition of gold on metal surfaces in a simple manner so that the deposited gold layer is dense and sufficiently thick to be readily solderable.

This type of deposited gold layer is particularly significant with terminal humps (Bauteile Report, 16 (1978) No. 2, pages 40–44) constructed of copper in passivated, integrated circuits (wafers) because the passivation and circuit components cannot be destroyed in the gilding process. Moreover, the semiconductor/PN surfaces photoeffect should not impede or disrupt the gold deposition onto the terminal humps of the integrated circuits. Further, gold depositions cannot occur on the passivation layer and/or on the silicon wafer.

In accordance with the principles of the invention, the initially described gilding bath is improved by providing therein organic compounds having at least one enol group in the molecule thereof as a reducing agent and adjusting the pH value of the bath with a buffer solution so as to range between about 7.5 to 12 and preferably adjusting the pH value of the bath to about 8.

An essential advantage attained by a chemical gilding bath formulated in accordance with the principles of the invention is that the resultant bath is stable and is in no need of continuous monitoring and re-supplying of chemicals or reagents for maintaining a constnt pH value. Further, such a bath is maintenance-free and produces no noxious odors (for example $NH_3$—).

In certain preferred embodiments of the invention, a chemical gilding bath is formulated so as to have a gold content equivalent to about 0.1 to 12 gr/l and to include L(+)-ascorbic acid, or, respectively, its salts, calcium- or sodium-L(+)-ascorbate, or mixtures thereof in an amount equivalent to a range between about 0.1 to 20 gr/l, and preferably equivalent to a range between about 5.0 and 7.0 gr/l.

A suitable chemical gilding bath formulated in accordance with the principles of the invention does not require pH monitoring and is not adversely influenced by the thermal or semiconductor/PN surfaces photoeffects during gold deposition onto copper humps in integrated circuits. Even with prolonged immersion times, the passivation structures and circuit itself exhibit no signs of attack whatsoever.

Gilding baths formulated in accordance with the principles of the invention can contain, in combination with the above-described reducing agents, EDTA (ethylen diamine tetracetic acid)-tetrasodium salt (tetrahydrate) as a stabilizing agent in an amount equivalent to a range between about 0.1 to 30 gr/l and preferably equivalent to about 3 gr/l.

Gilding baths formulated in accordance with the principles of the invention are, during operation, maintained over a temperature range extending between about 45° to 96° C. and preferably are maintained at a temperature of about 63° C.

DESCRIPTION OF PREFERRED EMBODIMENTS

Chemical gilding baths of the invention for depositing gold on various metals, such as copper, nickel or iron as well as on nickel-copper, nickel-iron-copper or nickel-iron alloys, are formulated on the basis of an alkaline, aqueous solution of an alkali gold cyanide complex and contain a compatible reducing agent and a compatible stabilizing agent therein.

The inventive gilding baths are formulated with relatively pure water, preferably deionized water, an alkali gold cyanide complex, such as potassium gold cyanide, a buffering reagent, such as an admixture of disodium hydrogen phosphate-2-hydrate with citric acid; potassium hydrogen phosphate admixed with disodium hydrogen phosphate-2-hydrate, or, boric acid admixed with sodium carbonate-1 hydrate, an organic reducing agent having enol groups in the molecule thereof, preferably selected from the groups consisting of L(+)-ascorbic acid, calcium-L(+)-ascorbate, sodium-L(+)-ascorbate and mixtures thereof and a compatible stabilizing agent, such as in EDTA tetrasodium salt (tetrahydrate).

The inventive gilding baths are operable in a temperature range extending between about 45° to 95° C. and are preferably operated at about 63° C.

With the foregoing general discussion in mind, there is presented detailed examples of buffering solutions and a gilding bath formulation which will illustrate to those skilled in the art the manner in which this invention is carried out. However, the examples are not to be construed as limiting the scope of the invention in any way.

EXAMPLE 1

An exemplary buffer solution providing a pH value of 8 for a 1 liter solution and useful in the practice of the invention comprises:

750 ml of DI (deionized) water
32 gr of disodium hydrogen phosphate-2-hydrate
1 gr of citric acid, and
sufficient DI water, up to 1 liter.

EXAMPLE 2

Another exemplary buffer solution useful in the practice of the invention can consist of the following composition:

750 ml of DI water
2 gr of potassium hydrogen phosphate 32 gr of disodium hydrogen phosphate-2-hydrate, and sufficient DI water, up to 1 liter.

EXAMPLE 3

Yet another exemplary buffer solution useful in the practice of the invention can consist of the following composition:

750 ml of DI water 20 gr of boric acid 4 gr of sodium carbonate-1 hydrate, and sufficient DI water, up to 1 liter.

The reagent amounts in the above buffer solutions can be increased in the same ratio for a higher buffer capacity if desired.

EXAMPLE 4

An exemplary reductively, auto-catalytically functioning gilding bath of the invention for gilding, for example, specific regions (metal) on IC's can consist of the following formulation:

1 liter buffer solution at a pH value of 8

3 gr/l EDTA tetrasodium salt (tetrahydrate)

6 gr/l sodium-L(+)-ascorbate, and 3 gr/l potassium gold cyanide.

The metals nickel, iron, as well as copper-iron, nickel-copper-iron or nickel-iron alloys can be auto-catalytically gilded, in addition to copper with the inventive gilding baths.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. In a chemical, auto-catalytical gilding bath for electrodeless gilding of metals and having an amount of a water-soluble alkali gold cyanide complex therein which functions in the alkaline pH range and having a compatible reducing agent and a compatible stabilizing agent therein, the improvement comprises employing as said reducing agent an organic compound having at least one enol group in the molecule thereof and also employing as said stabilizing agent ethylene diamine tetraacetic acid tetrasodium salt, and adjusting the pH of said bath with a buffer solution so as to have a value ranging between about 7.5 and 12.

2. In a chemical, auto-catalytical gilding bath as defined in claim 1, wherein the pH value of said bath is adjusted with a buffer solution to about 8.

3. In a chemical, auto-catalytical gilding bath as defined in claim 1, wherein the amount of gold in said bath is equivalent to a range between about 0.1 to 12 gr/l and the reducing agent is selected from the group consisting of L(+)-ascorbic acid, calcium-L(+)-ascorbate, sodium-L(+)-ascorbate and mixtures thereof, said reducing agent being present in said bath in an amount equivalent to a range between about 0.1 and 20 gr/l.

4. In a chemical, auto-catalytical gilding bath as defined in claim 3, wherein the amount of said reducing agent in said bath is equivalent to a range between about 5.0 and 7.0 gr/l.

5. In a chemical, auto-catalytical gilding bath as defined in claim 1, wherein said ethylene diamine tetraacetic acid tetrasodium salt is present in an amount ranging between about 0.1 to 30 gr/l.

6. In a chemical, auto-catalytical gilding bath as defined in claim 5, wherein said stabilizing agent is present in said bath in an amount equivalent to about 3 gr/l.

7. In a chemical, auto-catalytical gilding bath as defined in claim 1 wherein, during operation, said bath is maintained at a temperature in a range of about 45° and 96° C.

8. In a chemical, auto-catalytical gilding bath as defined in claim 7 wherein, during operation, said bath is maintained at a temperature of about 63° C.

* * * * *